US005878888A

United States Patent [19]

Faughey et al.

[11] Patent Number: 5,878,888

[45] Date of Patent: Mar. 9, 1999

[54] PUSH THROUGH AND PEEL CHILD RESISTANT BLISTER PACKAGE

[75] Inventors: Lynn A. Faughey, Harleysville; Kenneth E. Fuller, Ambler, both of Pa.

[73] Assignee: McNeil-PPC, Inc., Skillman, N.J.

[21] Appl. No.: 933,182

[22] Filed: Sep. 18, 1997

Related U.S. Application Data

[60] Provisional application No. 60/027,304 Oct. 10, 1996.

[51] Int. Cl.[6] ..... B65D 83/04

[52] U.S. Cl. ..... 206/530; 206/532; 206/807

[58] Field of Search ..... 206/469, 484, 206/528, 530–533, 534.1, 534.2, 538, 539, 807, 820

[56] References Cited

U.S. PATENT DOCUMENTS

| | | | |
|---|---|---|---|
| 3,835,995 | 9/1974 | Haines | 206/539 |
| 3,872,970 | 3/1975 | Edison | 206/469 |
| 3,921,805 | 11/1975 | Compere | 206/469 |
| 3,924,746 | 12/1975 | Haines | 206/469 |
| 4,011,949 | 3/1977 | Braber et al. | 206/469 |
| 4,243,144 | 1/1981 | Margulies | 206/469 |
| 4,294,361 | 10/1981 | Margulies et al. . | |
| 5,325,968 | 7/1994 | Sowden | 206/538 |
| 5,358,118 | 10/1994 | Thompson et al. | 206/538 |
| 5,511,665 | 4/1996 | Dressel et al. . | |
| 5,529,188 | 6/1996 | Coggswell . | |
| 5,551,567 | 9/1996 | Malone et al. . | |

*Primary Examiner*—Paul T. Sewell
*Assistant Examiner*—Luan K. Bui
*Attorney, Agent, or Firm*—Kenneth J. Dow

[57] ABSTRACT

The invention is a child resistant and easy to use blister package for containing a solid medicament that utilizes a push through and peel mechanism as an opening feature. The multi-section blister card package has an opening mechanism featuring a cut-out in the blister container sheet which is adjacent to the cavity containing the product and a corresponding weakened area such as a perforation or score in the closure sheet positioned slightly inside and adjacent to the edge of the cut-out in the container sheet. The blister is opened by pushing through the closure sheet at the perforation to form a pull-tab which can be used to peel the closure sheet from the container sheet towards the product cavity thereby exposing the product cavity to remove the product.

1 Claim, 2 Drawing Sheets

PUSH THROUGH AND PEEL CHILD RESISTANT BLISTER PACKAGE

This application claimed the benefit of U.S. Provisional application Ser. No. 60/027,304, filed Oct. 10, 1996.

FIELD OF THE INVENTION

The present invention relates to a blister card package for the packaging and delivery of solid medicaments such as tablets or capsules that is both child resistant and easy to use by adults and seniors.

BACKGROUND OF THE INVENTION

Blister card packages are one form of container commonly used for the packaging of medicaments, particularly for unit-dose packaging where the delivery of individually packaged dosage units to the consumer or patient is desirable. A suitable blister card package provides a container for the delivery of solid medicaments that is tamperproof, airtight, uses conventional materials and equipment to produce and is thus economical.

Generally, a conventional blister card package provides a container for individual dosages of the medicament separately packaged for delivery of the individual dosage to a patient. Typically, a blister card package contains a number (usually about 6–8) of individual dosages on a card where each dosage is separately contained and can be separated by perforations such that it can be readily detached. The blister card package is usually constructed of several layers. The top layer is a container sheet or container formstock contructed of a rigid material having integrally formed cavities or wells designed to hold the dosage form. The container sheet is sealed to a closure sheet (or lidstock) generally constructed of a foil and paper laminate. The blister package can be designed for removal of the dosage form from the container in a variety of ways. In some packages, the dosage is removed by pressing it through the closure sheet, where the closure sheet is made from a rupturable material. In other designs, the closure sheet is designed to be peeled off from the container sheet to remove the dosage form. Alternatively, the blister is scored to form a weakened area enabling the user to tear the blister and expose the cavity containing the tablet.

In designing a suitable blister card package, it is desirable that the package be tamper resistant and airtight but be easily opened by adults. At the same time, it is often desirable that the package be child-resistant and not easily opened by children. A problem with many conventional blister packages is that they are difficult to open, particularly by seniors or others with impaired dexterity but even by a healthy adult. In a rupturable package, the tablet or capsule may be damaged during opening. In a peel-apart package, the layers can be difficult to manipulate and separate because the layers are thin and tightly sealed. Thus, there is a need for a blister card package design which allows easy access by adults, including seniors, yet passes child resistant testing. There is also a need for a blister card package which meets these requirements and which utilizes conventional materials and can be manufactured using conventional equipment.

U.S. Pat. No. 4,294,361 discloses a blister strip package having two cavities; a first cavity for containing the dosage form, and a second cavity laterally aligned with the first cavity which is covered by an unsealed area in the closure sheet having scored lines for disruption of the closure sheet. In operation, the second cavity is completely inverted to bear upon the covering sheet to disrupt it at the scored lines forming a pull tab to peel the closure sheet from the container sheet.

SUMMARY OF THE INVENTION

The invention is a child resistant and easy to use blister package for containing a solid medicament that utilizes a push through and peel mechanism as an opening feature. The multi-section blister card package comprises a rigid container sheet with cavities for containing the product such as a solid dosage form medicament, and a backing closure sheet sealed to the container sheet and covering the product cavities. The opening feature is accomplished using a cut-out in the blister container sheet which is adjacent to the cavity containing the product and a corresponding weakened area such as a perforation or score in the closure sheet positioned slightly inside and adjacent to the edge of the cut-out in the container sheet. The blister is opened by pushing through the closure sheet at the perforation to form a pull-tab which can be used to peel the closure sheet from the container sheet towards the product cavity thereby exposing the product cavity to remove the product.

In one embodiment, the blister pack incorporates an unsealed area of the closure sheet surrounding the cut-out in the container sheet which facilitates the formation of the pull-tab when the blister pack is opened.

BRIEF DESCRIPTION OF THE DRAWINGS

The invention described herein will be better understood from the attached drawings, which include.

DETAILED DESCRIPTION

Figure 1:
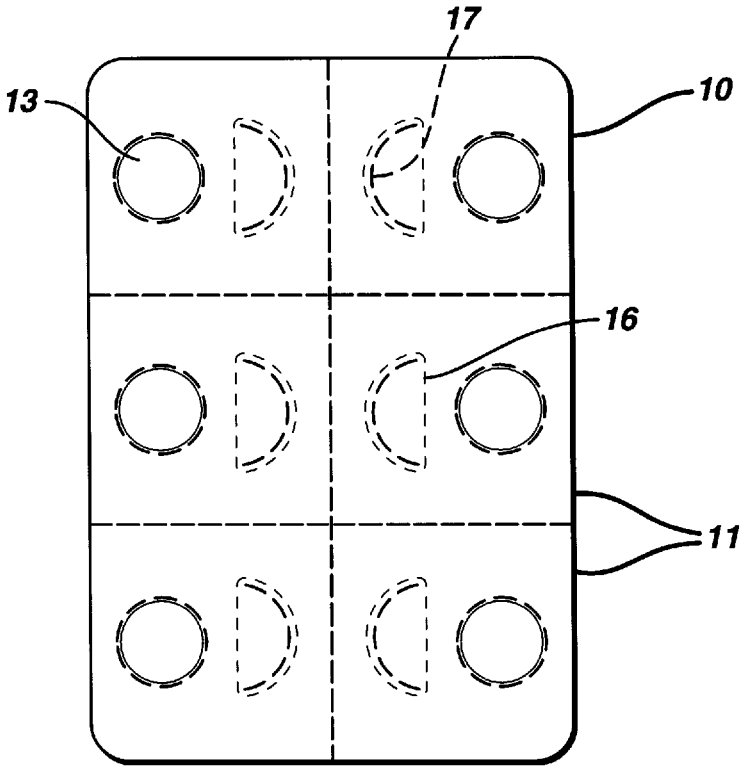
FIG. 1 is a top plan view of a typical embodiment of a blister package of the present invention.

The invention described herein can be seen in FIGS. 1 through 4. There is contained a blister package 10 separated into individual dosage sections 11 which are separable from the remainder of the package 10 via score lines or perforations. Each individual section is provided with a raised product cavity 13 to accommodate a product such as a tablet, capsule or the like. As shown in FIG. 1, in this package 10 there are typically six sections on the blister pack, although other alternate configurations are possible. For example, a blister card may be configured to contain eight or twelve sections. Each of the sections may be detached from the blister package 10 by bending and tearing along the lines of perforations, as known in the art.

Figure 2:
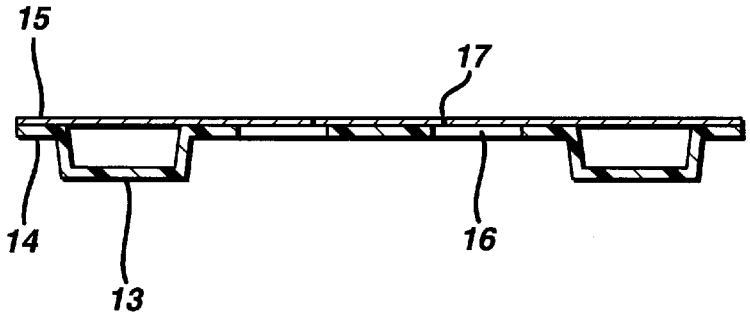
FIG. 2 is a cross sectional view of a blister package of the present invention.
Figure 4:
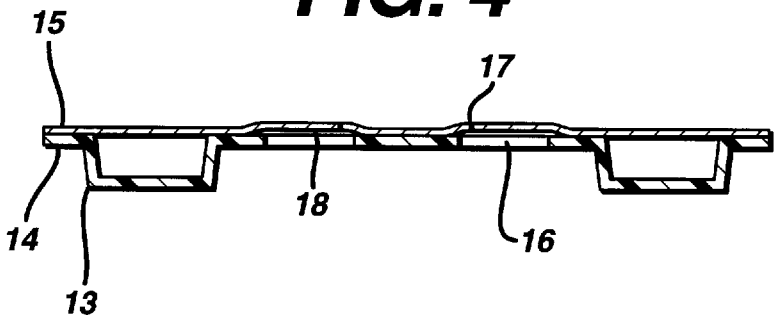
FIG. 4 is a cross sectional view of the blister pack of FIG. 3.

The blister package 10 has at least two layers as shown in FIGS. 2 and 4. The first layer is a container sheet 14 made of a rigid, heat sealable material from which the product cavities 13 may be formed. The second layer is a closure sheet 15 which is heat sealed to the container sheet as indicated in FIG. 2. The closure sheet 15 completely overlays the cavity bearing container sheet 14 and is heat sealed or glued to the container sheet 14 to provide an airtight seal. Both the container sheet layer 14 and the closure sheet layer 15 are formed from conventional materials.

The container sheet 14 is preferably formed of a strong, rigid polymeric material, such as transparent polyvinyl chloride, polyvinyl dichloride, polyethylene or polypropylene. The container sheet has a substantial thickness of up to about 25 mils, more preferably about 10 mils, to provide the needed rigidity and to protect the contents of the blisters form damage during shipping. The container sheet should have the required strength to prevent access by a child. The product cavities 13 are integrally formed in the container sheet and have the desired configuration to contain the product.

The closure sheet 15 is preferably a laminate of thin metal foil such as aluminum foil and paper. The foil side of the laminate faces the product contained in the cavity and the paper side provides the bottom layer of the blister card package. The paper layer typically serves as the label for the blister card package.

The container sheet 14 and the closure sheet 15 are typically sealed together by means of heat sealing or adhesives as known in the art.

Adjacent to, and laterally aligned with the product cavity 13 of the container sheet 14 is a corresponding cut-out 16 in the container sheet 14, which, as shown if FIG. 1, is preferably formed in the shape of a "D" and is large enough to accommodate a thumb or forefinger. The closure sheet 15 covering this cut-out area 16, has a perforation or score 17 adjacent to and laterally aligned with the edge of the cut-out 16. In use, the blister package 10 is opened by pushing the closure sheet on the product cavity side by applying pressure in the cut-out area at the perforation or score line 17. In doing so, a pull tab is formed allowing one to easily separate and pull the closure sheet 15 towards the product cavity 13 and exposing the product for removal from the blister package.

Figure 3:
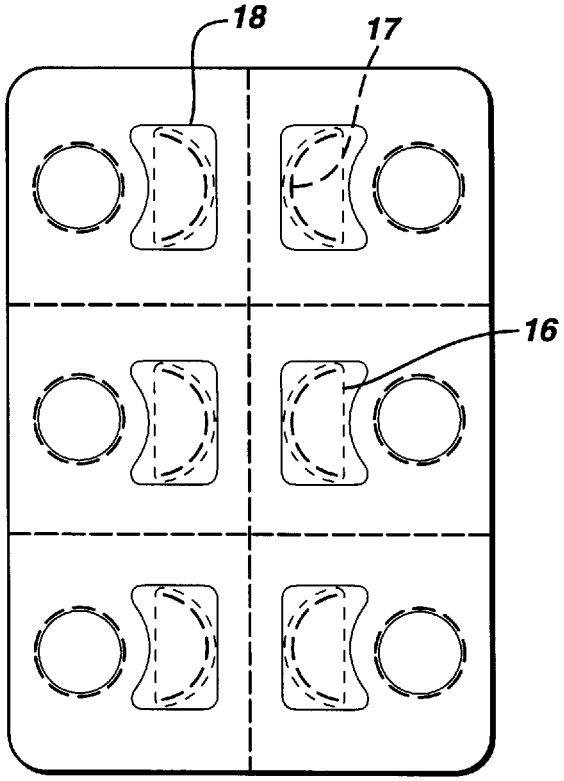
FIG. 3 is a top plan view of an alternate embodiment of a blister pack of the invention.

In the embodiment shown in FIG. 3, an unsealed area 18 of the closure sheet 15 surrounds the cut-out area 16 and assists in the formation of the pull-tab when pressure is applied through the cut-out area making the blister pack easier to open.

Child resistance is provided by the present invention since one must obviously understand the procedure required to apply pressure at the score line to form the pull tab for peeling back the closure sheet.

We claim:

1. A blister card package comprising:

(a) a rigid container sheet having a product cavity formed therein adapted to contain a medicament dosage;

(b) a cut-out area in the container sheet adjacent to the product cavity;

(c) a closure sheet completely covering the product cavity and container sheet, said closure sheet being sealed to the container sheet except at the product cavity and the cut-out area;

(d) a weakened area in the closure sheet inside the cut-out area and laterally aligned with the edge of the cut-out in the container sheet adapted to form a pull tab in the closure sheet for peeling back the closure sheet when pressure is applied at the weakened area thereby enabling the product cavity to be exposed for removal of the medicament dosage; and (e) an unsealed area of the closure sheet surrounding the cut-out in the container sheet which facilitates the formation of the pull-tab when the blister pack is opened.

* * * * *